US007861763B2

(12) United States Patent
Leist et al.

(10) Patent No.: US 7,861,763 B2
(45) Date of Patent: Jan. 4, 2011

(54) METHOD OF MAKING AN OPTIMIZED OVERHEAD SECTIONAL DOOR AND ASSOCIATED DOOR PANEL

(75) Inventors: Alan R. Leist, Cincinnati, OH (US); Thomas E. Youtsey, Wilder, KY (US)

(73) Assignee: Clopay Building Products Company, Inc., Mason, OH (US)

( * ) Notice: Subject to any disclaimer, the term of this patent is extended or adjusted under 35 U.S.C. 154(b) by 42 days.

(21) Appl. No.: 12/341,075

(22) Filed: Dec. 22, 2008

(65) Prior Publication Data

US 2009/0100763 A1 Apr. 23, 2009

Related U.S. Application Data

(62) Division of application No. 10/991,776, filed on Nov. 18, 2004, now abandoned.

(51) Int. Cl.
*E06B 3/12* (2006.01)

(52) U.S. Cl. ..... 160/236; 52/745.19

(58) Field of Classification Search ..... 160/236, 160/201, 232; 52/792.1, 800.1, 745.15, 745; 29/897.32

See application file for complete search history.

(56) References Cited

U.S. PATENT DOCUMENTS 2,457,129 A * 12/1948 Collings ..... 52/792.1
2,729,130 A * 1/1956 Walker ..... 82/11.5
2,796,959 A * 6/1957 Toney ..... 52/792.1
2,968,829 A 1/1961 Meddick
3,213,583 A 10/1965 Winski
3,511,301 A 5/1970 Graham et al.
3,941,180 A 3/1976 Thill
3,967,671 A 7/1976 Stanley et al.
4,161,567 A * 7/1979 Sturgeon ..... 428/594
4,236,366 A * 12/1980 Rijnders ..... 52/580

(Continued)

OTHER PUBLICATIONS

Katherine Mitchell; International Search Report and Written Opinion; Mar. 17, 2008; 5 pages; Alexandria, VA.

(Continued)

*Primary Examiner*—Blair M. Johnson
(74) *Attorney, Agent, or Firm*—Wood, Herron & Evans, LLP

(57) ABSTRACT

A panel (14) for an overhead sectional door (10) offers increased performance and economy by optimizing the panel skin (38, 42, 50, 52). The upper and lower structural rail areas (46, 48) which typically mate with corresponding lower and upper rails (48, 46) of an adjacent panel (14) have thicker skin (38, 42, 50, 52). The non-structural areas or the front face of the panel (14) in one embodiment has a thinner skin (38, 42) which is typically embossed with a wood grain or other pattern. The structural rail areas (46, 48) which have the thicker skin (50, 52) add rigidity and resistance to deflection from wind loads and similar dynamic forces. The overhead door panel (14) with differing performance characteristics for specific portions of the skin (38, 42, 50, 52) may be utilized with a variety of rail configurations (46, 48) such as a lap joint, tongue and groove joint, and convex/concave joint between adjacent panels (14). In another aspect, a specific bottom rail section (48) using the variable thickness concept avoids the need for an astragal retainer thereby providing a cost savings while offering structural and strength benefits.

17 Claims, 4 Drawing Sheets

U.S. PATENT DOCUMENTS

| | | | | |
|---|---|---|---|---|
| 4,238,544 | A | | 12/1980 | Mullet |
| 4,339,487 | A | | 7/1982 | Mullet |
| 4,589,240 | A | | 5/1986 | Kendall et al. |
| 4,685,266 | A | | 8/1987 | Mullet |
| 4,779,325 | A | | 10/1988 | Mullet |
| 4,893,666 | A | | 1/1990 | Hörmann |
| 4,979,553 | A | | 12/1990 | Lowry, III et al. |
| 4,989,660 | A | | 2/1991 | Wagner |
| 4,995,441 | A | | 2/1991 | Leist et al. |
| 5,002,114 | A | | 3/1991 | Hörmann |
| 5,016,700 | A | | 5/1991 | Wegner et al. |
| 5,129,441 | A | | 7/1992 | Leist et al. |
| 5,170,832 | A | | 12/1992 | Wagner |
| 5,396,735 | A | | 3/1995 | Dietrich |
| 5,435,108 | A | | 7/1995 | Overholt et al. |
| 5,509,457 | A | | 4/1996 | Jellá |
| 5,669,431 | A | | 9/1997 | Druzynski et al. |
| 5,827,458 | A | * | 10/1998 | Meadows ..... 264/46.2 |
| 5,915,444 | A | | 6/1999 | Sastri et al. |
| 6,076,590 | A | | 6/2000 | Ford et al. |
| 6,330,901 | B1 | | 12/2001 | Friesen et al. |
| 6,418,697 | B1 | * | 7/2002 | Da Molin ..... 52/792.11 |
| 6,712,117 | B2 | | 3/2004 | Jellá |
| 6,772,818 | B2 | | 8/2004 | Whitley et al. |

OTHER PUBLICATIONS

Athina Nickitas-Etienne; International Preliminary Report on Patentability; Mar. 3, 2009; 4 pages; Geneva, Switzerland.

* cited by examiner

METHOD OF MAKING AN OPTIMIZED OVERHEAD SECTIONAL DOOR AND ASSOCIATED DOOR PANEL

This is a divisional of U.S. patent application Ser. No. 10/991,776, filed Nov. 18, 2004 and hereby incorporated by reference in its entirety.

BACKGROUND OF THE INVENTION

This invention relates to overhead doors and, more particularly, to overhead sectional door panels having sheet like skins and the associated method of manufacturing such systems.

There are numerous designs of overhead or retractable door assemblies which are commonly used for garage doors, truck doors, warehouse doors or the like. Typically, an overhead door of this type is convertible between an open, overhead or generally horizontal configuration and a closed generally vertically oriented configuration in which the door closes an opening in the building or the like. The overhead door is typically movable along a track assembly mounted proximate the opening and the track assembly commonly includes a generally vertical track section, a generally horizontal track section and a curved transition track section joining the horizontal and vertical sections together.

Retractable overhead doors of this type are conventionally constructed of a number of vertically arranged, horizontally oriented panels which can fold along the horizontal divisions between the panels to enable the door to pass along the curved transition section of the track when being opened or closed. The panels can be pivotally coupled together with hinges on the interior surface or back face of the door panels. The hinges articulate during pivotal movement of the panels. Such door panels for many years were predominantly constructed of wood. However, wood door panels are both costly to manufacture and heavy in use, resulting in difficulty when opening and closing the garage door.

Recently, sectional overhead door panels having an outer metal skin have become popular and have replaced wooden door panels in many applications. Commonly, sectional overhead door panels which are rolled or formed by thin sheet metal require internal reinforcing members, typically constructed of wood or metal. Center and end stiles are often provided within the sheet metal door panel for the required reinforcement.

However, in many instances to obtain a lightweight panel with the requisite strength and rigidity, the sheet metal skin thickness must be increased. This increased skin thickness can add significant material and production costs to the door panel. In many applications, the added strength resulting from the increased skin thickness is required. However, it is well recognized that no single overhead door panel design satisfies the needs of all applications and installations. In addition to skin thickness and strength, a wide range of other panel characteristics may be altered for the appropriate panel design for a given application. However, in known overhead door systems, a change in one panel characteristic typically requires an entire different door panel, skin and/or associated components and production scheme. Such changes are inefficient from both a cost and production schedule standpoint.

Another aspect of known overhead sectional doors is the use of an astragal strip mounted along the bottom edge of the lowermost panel to seal the door against the floor. However, since the door panels are typically manufactured as identical components, mounting hardware is required to install the astragal to the lowermost panel of the overhead door. Such added mounting hardware often adds weight to the door, increases both the inventory of components and the cost of installation of the door.

As evidenced by the above background, a need exists for overhead door panel which provides the required performance characteristics including, among others, strength and rigidity to withstand the wind and structural loads associated with many overhead door applications while remaining lightweight. Furthermore, the door panel must be efficiently, easily and economically manufactured with a minimum of component parts while providing the desired physical attributes.

SUMMARY OF THE INVENTION

The various embodiments of this invention offer these and other advantages over known overhead door and panel designs. In one embodiment, this invention includes a number of horizontally oriented panels vertically stacked one upon the other in edge-to-edge relationship.

The panels are coupled to a track assembly mounted proximate the garage, warehouse, truck or other opening. The track assembly includes a generally vertical section, a generally horizontal section and a curved transition section joining the horizontal and vertical sections together. Rollers are mounted on the panels and coupled to the track assembly to guide the door between a closed generally vertical configuration with the upper and lower edges of the adjacent panels mated together and an open generally horizontal configuration extending generally parallel to the ceiling of the garage or the like.

One aspect of this invention includes a door panel having a front skin presenting an exterior front face and a back skin presenting an interior back face. The skins in one embodiment are metal and the panels are filled with a foam or other insulating material. The panels each have mating upper and lower edges.

This invention provides for an optimized design of the panel with respect to a variety of performance characteristics, one of such characteristics is increased strength of an overhead door panel by optimizing the thickness of the skin. More specifically, the upper and lower structural rail areas which typically mate with corresponding lower and upper rails of an adjacent panel have thicker skin. The non-structural areas or the front face of the panel have a thinner skin which is typically embossed with a wood grain or other pattern. The structural rail areas which have the thicker skin add rigidity and resistance deflection to wind loads and similar dynamic forces.

The differing thickness portions of the skin on the overhead door panel are achieved by mechanically or otherwise fastening different sheets of the appropriate thickness material together by a lock seam or other technique before, after or during the roll forming of the skin profile of the overhead door. The lock seam for interlocking engagement of the distinct sheets of the skin also improves the structural integrity of the panel.

The overhead door panel with differing thicknesses for specific portions of the skin may be utilized with a variety of rail configurations such as a lap joint, tongue and groove joint, and convex/concave joint between adjacent panels. The joint or lock seam between the differing thickness sheets may be located on the rail section itself or on the front face of the panel adjacent the juncture between the rail section and the front face. The skin thickness of the various panel sections is just one of a number of performance characteristics that can be optimized according to this invention and other characteristics include, without limitation, the tensile or yield strength, grade of the material, color, finish, coating, material, paint, and texture of the panel sections.

Another aspect of the invention is a specific bottom rail section using the optimization concept. The specific bottom rail section avoids the need for separate mounting hardware or an astragal retainer thereby providing a cost savings while offering the benefits discussed above.

As a result, the overhead sectional door, panel and associated methods of manufacture offer reliable and consistently robust and lightweight panels produced through economical and efficient manufacturing techniques not heretofore realized in the industry.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
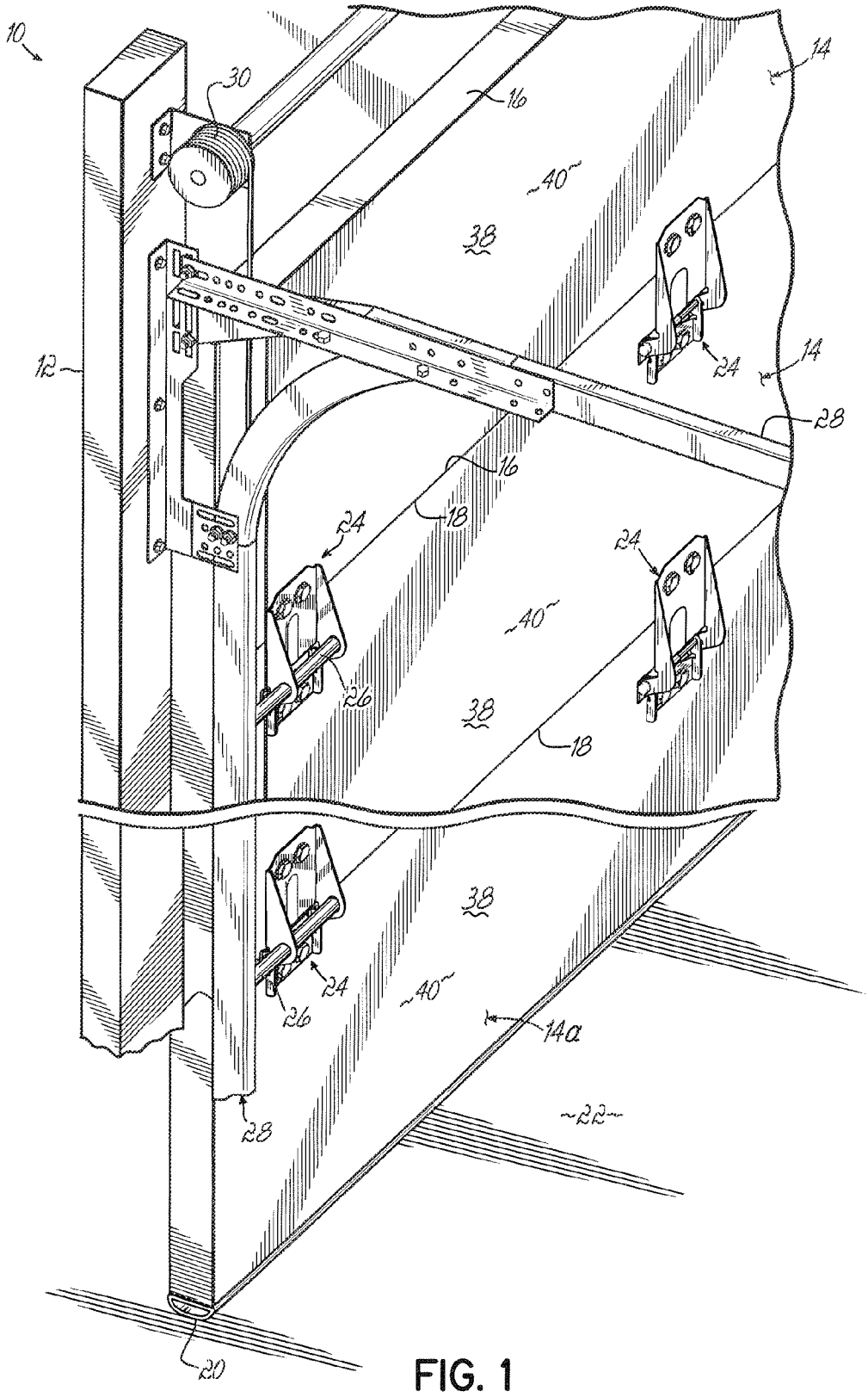
FIG. 1 is a perspective view of an overhead door with associated panels according to one embodiment of this invention.

Referring to FIG. 1, a presently preferred embodiment of a portion of an overhead door 10 according to this invention is shown in a closed generally vertical configuration covering an opening in a wall 12 of a garage, warehouse or the like. The door 10 includes a number of panels 14. Each panel 14 includes upper and lower generally horizontally oriented edges 16, 18 which are configured to mate with the lower and upper edges 18, 16 respectively, of an adjacent panel 14 when the door 10 is in the closed configuration as shown in FIG. 1. The lowermost panel 14*a* of the door 10 includes an astragal 20 for sealing the door 10 against a floor 22.

The adjacent panels 14 are pivotally connected together by a number of hinge assemblies 24. The hinges 24 proximate the lateral side ends of each panel 14 include a roller assembly 26 for coupling the door 10 to a track assembly 28. The opening and closing of the door 10 may be assisted by a counterbalance system 30 coupled to the door 10 as is well known in the art.

Figure 2A:
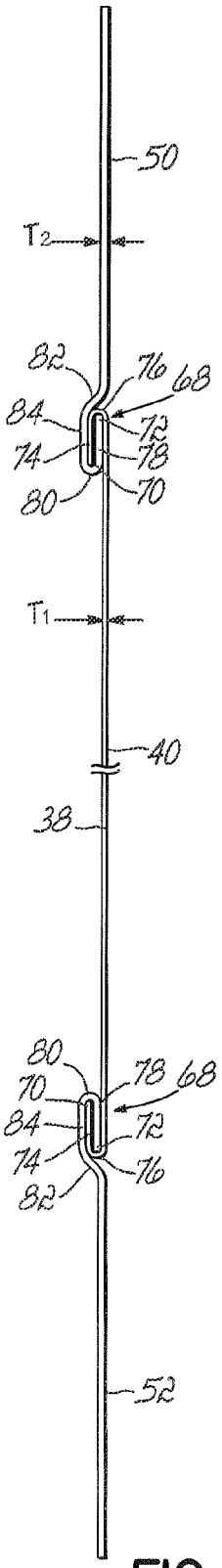
FIGS. 2A-2B are side elevational views of a first embodiment of an overhead door panel being manufactured according to this invention.
Figure 2B:
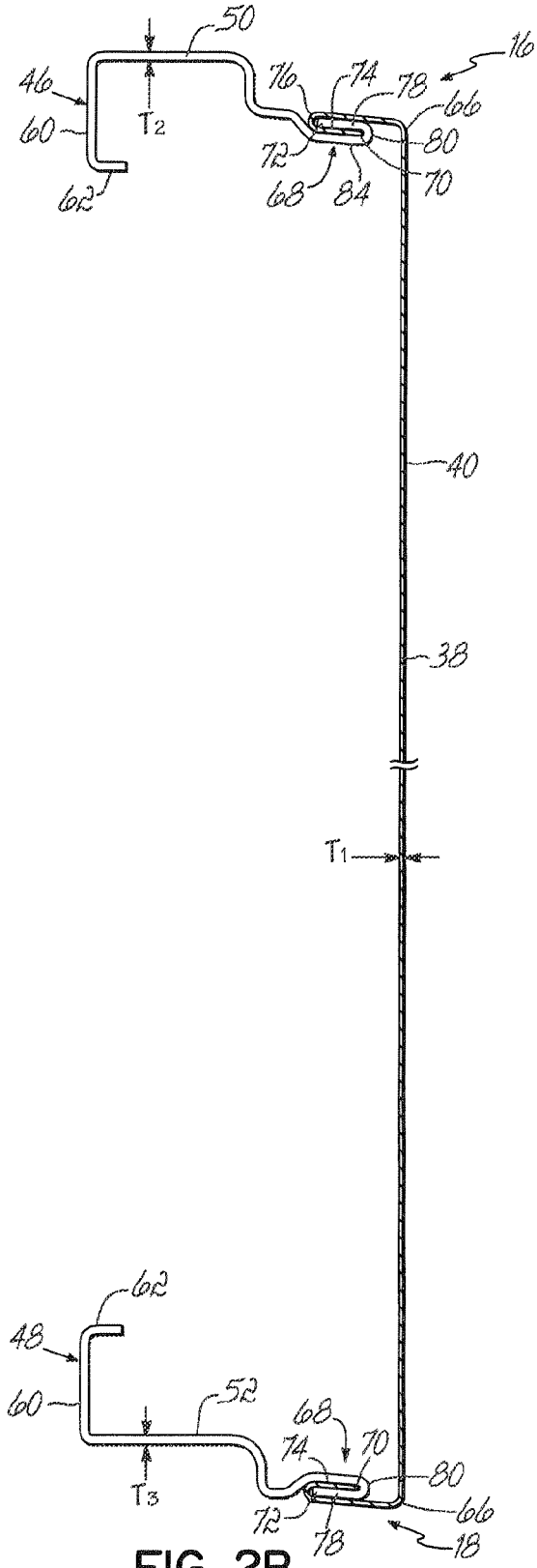
Figure 2C:
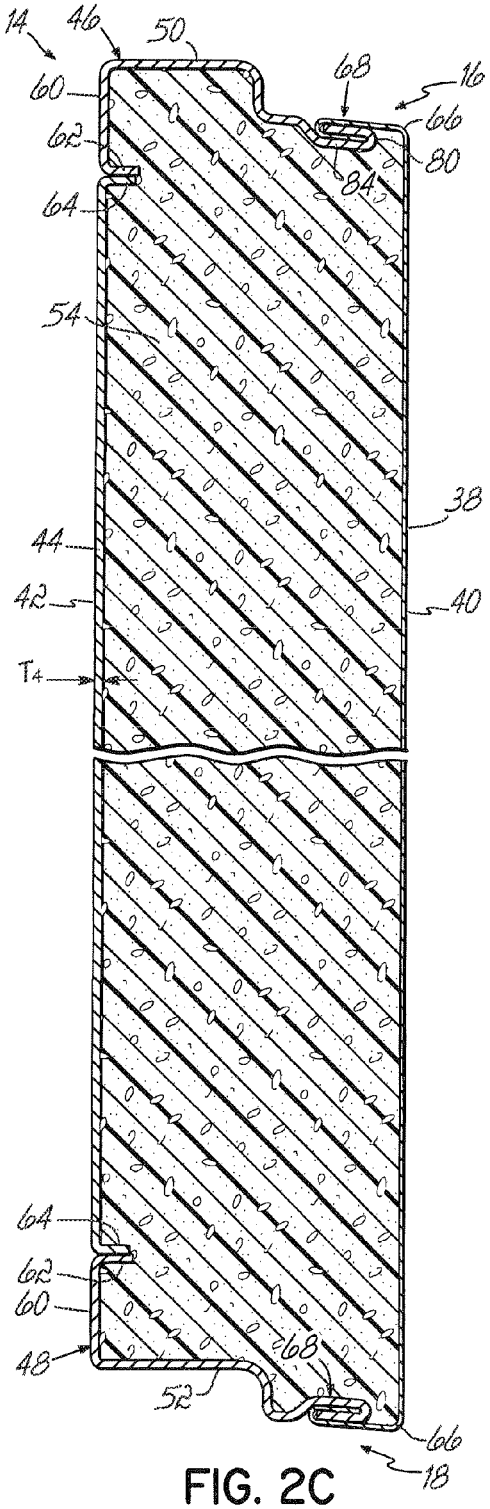
FIG. 2C is a cross-sectional view of the first embodiment of an overhead sectional door panel according to this invention.
Figure 3:
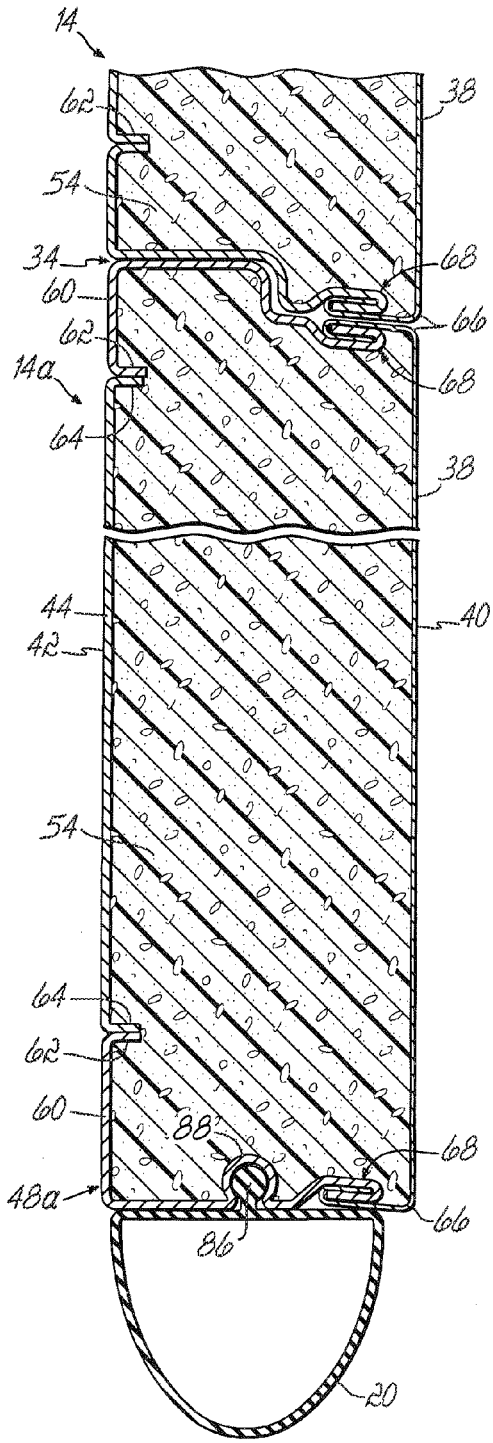
FIG. 3 is a cross-sectional view of a lowermost panel of the overhead door with an astragal receiver and astragal according to this invention.
Figure 4:
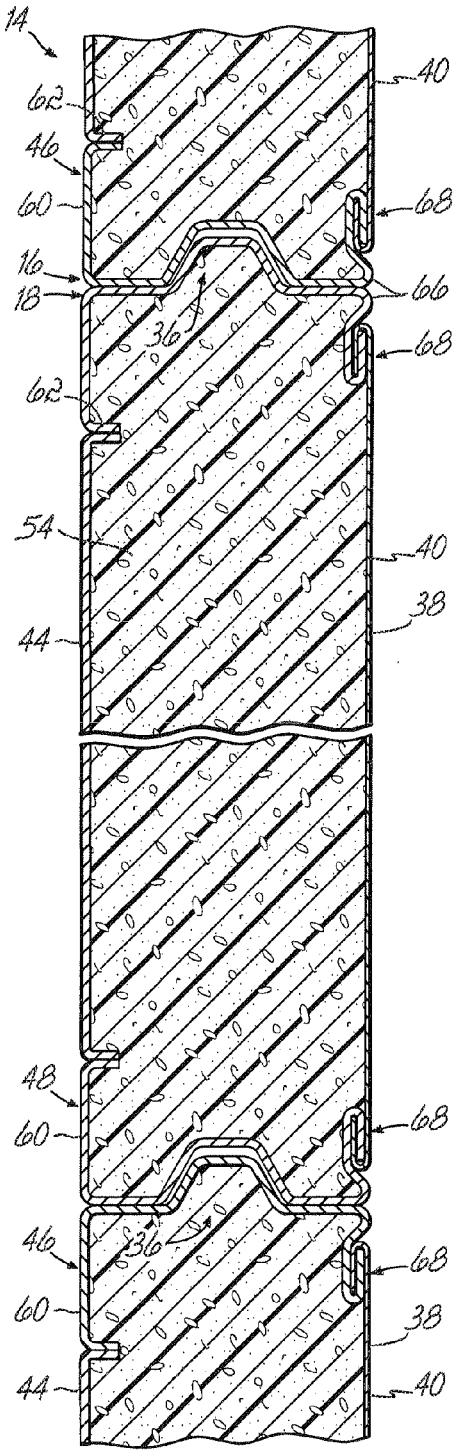
FIG. 4 is a cross-sectional view of a second embodiment of a number of overhead sectional door panels according to this invention.
Figure 5:
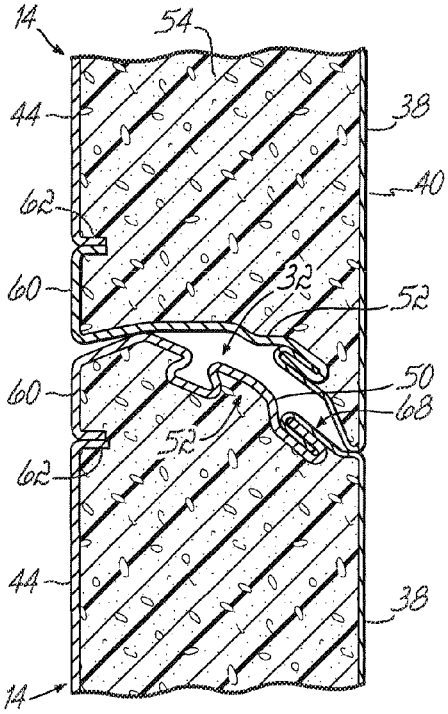
FIG. 5 is a cross-sectional view of a third embodiment of a pair of mating overhead sectional door panels according to this invention.

Referring to FIGS. 3-5, lower edge 18 of each panel 14 mates with the upper edge 16 of an adjacent panel 14 according to presently preferred embodiments of this invention. A more detailed disclosure of the convex/concave joint edge configuration 32 according to one embodiment of this invention as shown in FIG. 5 is found in U.S. Pat. No. 6,006,817, assigned to the assignee of this invention and hereby incorporated by reference in its entirety. Nevertheless, this invention is readily employed on a panel design of another configuration such as a lap joint 34 (FIGS. 2B-3), a tongue and groove joint 36 (FIG. 4) or other joint configuration.

Referring particularly to FIGS. 2B-5, each panel 14 according to the various embodiments in this invention includes a front skin 38 defining a front face 40 of the panel 14 and may include a back skin 42 defining, at least in part, a back face 44 of the panel 14. Each panel 14 also includes an upper top rail 46 and a lower bottom rail 48 adapted to mate with corresponding bottom and top rails 48, 46, respectively, according to the specific configuration of the panels 14. According to this invention, the top and bottom rails 46, 48 are formed from top and bottom rail skins 50, 52. Generally, each of the skins 38, 42, 50, 52 may be embossed sheet metal according to presently preferred embodiments of the invention. Insulation 54 is preferably provided to fill the internal volume defined by the front and back skins 38, 42 as is well known in the art. Reinforcing stiles (not shown) may be included in or on each panel 14 for added strength.

One feature of this invention is the ability to efficiently and economically optimize specific characteristics or physical attributes of the panel. As one example, the thicknesses of some of the skins 38, 42, 50, 52 are optimized. However, a wide range of other characteristics of the panel skins may be optimized within the scope of this invention, such as, without limitation, the strength (tensile, yield, etc.) of the skin materials, selection of skin materials (metal, thermoplastic, grade, etc.), grade of the material, color, finish, texture, and treatment of the skin materials to name but a few of the characteristics which could be optimized in this invention. Other such characteristics include the corrosion resistance, coatings, cost, galvanization (i.e., hot dipped, electro, etc.) and application of alloys (i.e., zinc, etc.).

In the one embodiment of the overhead sectional door panel 14 according to this invention, the front skin 38 has a different thickness $T_1$ than the top rail skin thickness $T_2$ and/or bottom rail skin thickness $T_3$. This provides for increased strength of the panel 14 by optimizing the thickness $T_2$, $T_3$ of the skins 50, 52 in the top and bottom rails 46, 48 which add rigidity and resistance to deflection of the panel 14 in response to wind loads and similar dynamic forces. Likewise, the front skin 38 having a thickness $T_1$ less than the structural top and bottom rail skins 50, 52 allows for more economical material costs and the associated production expenses. According to this invention, the top and bottom rail skins 50, 52 have the same thickness ($T_2$=$T_3$); however, the rail skins 50, 52 may have differing thicknesses relative to each other as is required in specific applications within the scope of this invention.

The top and bottom rails 46, 48 each include upper and lower edge configurations 16, 18 adapted to mate with the corresponding edge configurations 18, 16 of an adjacent panel 14 depending upon the configuration 32, 34, 36 of the juncture between the panels 14. Additionally, each rail 46, 48 includes a back face portion 60 and a terminal lip 62 according to various embodiments of this invention. The terminal lip 62 is adapted to mate with the terminal edges 64 of the back skin 42 if provided on the panel 14. The back skin 42 may be any one of a number of materials as is well known in the industry. If the back skin 42 is metal, it will preferably have a relatively thin thickness $T_4$ comparable to the front skin thickness $T_1$ and the associated costs and production benefits. In certain embodiments, the front skin 38 has a thickness $T_1$ of between 0.010 to 0.022 gage or higher and the top and bottom rail skins 50, 52 have a thickness $T_2$, $T_3$ of 0.019 to 0.04 gage or higher. While the thickness ranges overlap, the thickness $T_1$ is most preferably less than thickness $T_2$ and/or thickness $T_3$. The skins 38, 50, 52 may be smooth or embossed with a wood grain or other texture. A bend 66 is provided at the interface between the front face 40 and each of the rails 46, 48.

The top and bottom rail skins 50, 52 are joined to the front skin 38 by appropriate joints 68. One presently preferred embodiment of the joint 68 for joining the respective rail skins 50, 52 to the front skin 38 is a mechanical joint which, in one form, is a lock seam joint as shown in FIGS. 2A through 5. An edge 70 of the front skin 38 is joined to an edge 72 of one of the rail skins 50, 52 by the lock seam joint 68. In one configuration, the lock seam joint 68 includes a front skin return leg 74 joined by a fold 76 to the front skin 38. The return leg 74 and fold 76 are interlocked with a return leg 78 and fold 80 of the rail skin 50, 52 to thereby interlock the adjacent edges 70, 72 of the skins 38, 50, 52. Preferably, a jog 82 and an offset portion 84 are provided between the primary portion of the rail skin 50, 52 and the fold 80 so that when the lock seam joint 68 is formed, the primary portions of the front skin 38 and rail skins 50, 52 are generally planar with respect to each other as shown in FIG. 2A.

While a lock seam joint configuration is shown and described herein, it should be readily appreciated by those of ordinary skill in the art that other joint configurations and techniques are readily available within the scope of this invention for joining the rails skins 50, 52 and front skins 38 together. Moreover, mechanical joints such as the lock seam joint, as well as adhesive joints, can be utilized within this invention. Additionally, while distinct skin members 38, 50, 52 are shown joined together to form the panel 14 according to this invention, a single ply skin material having a portion for the front skin 38 and corresponding portions for the top and bottom rail skins 50, 52 with differing thicknesses $T_1$, $T_2$, $T_3$ could be utilized thereby avoiding the need for joining distinct skins together to form the panel 14. Furthermore, another embodiment of this invention would include top and/or bottom rails 46, 48 which are more than one ply of material thereby increasing the thicknesses $T_2$, $T_3$ of the rails without necessarily requiring thicker skin material and possibly avoiding the need for a joint between the front skin and rail skins. One such embodiment would utilize additional sheets formed in the configuration of the rail 50, 52 and nested with the appropriate rail section thereby increasing the thickness and strength of the rail 50, 52 according to this invention.

Moreover, the joint 68 between the front skin 38 and the rail skins 50, 52 may be located outboard of the bend 66 adjacent the front face 40 of the panel 14 as shown in FIGS. 2B through 3 and 5. Alternatively, the joint 66 may be located on the front face 40 inboard of the bend 66 adjacent the rail 50, 52 as shown in FIG. 4 or another location as is appropriate for specific applications and overhead door panel configurations within the scope of this invention.

Another aspect of this invention is the method for forming the panel 14 having differing thickness $T_1$, $T_2$, $T_3$ front skin 38 and rail skins 50, 52. After the rail skins 50, 52 are joined to the front skin 38 as shown in FIG. 2A, the generally planar panel sheet is then processed through standard roll forming machines currently in use for roll forming the rail sections of overhead sectional door panels. In this way, additional manufacturing equipment and techniques are not required to roll form the rails 50, 52 on the panels 14 beyond that which is currently in use.

A further aspect of this invention is shown in FIG. 3 in which the astragal 20 is mounted directly to the bottom rail 48*a* of the lowermost panel 14*a* of the door 10. The astragal 20 includes a bead-shaped connector 86 which is received within a rounded astragal receiver channel 88 in the bottom rail 48*a* of the lowermost panel 14*a*. According to this embodiment of the invention, the bottom rail of the lowermost panel 14*a* includes edge configuration 18*a* and not include the lower edge 18 joint configuration required to mate with the upper edge 16 of an adjacent panel 14 because the panel 14*a* is lowermost on the door 10. The astragal connector 86 is merely inserted either perpendicularly parallel or otherwise into the receiver 88 for mounting the astragal 20 directly to the bottom rail 48*a*. Therefore, additional mounting hardware, mechanical fasteners or other components heretofore required for mounting an astragal to the lowermost panel are avoided.

It should be readily appreciated that although certain embodiments and configurations of the invention are shown and described herein, the invention is not so limited. From the above disclosure of the general principles of the present invention and the preceding detailed description of at least one preferred embodiment, those skilled in the art will readily comprehend the various modifications to which this invention is susceptible. For example, while variable thickness of the skins provides an opportunity to tune performance of the panel, the skin thicknesses could remain uniform depending on the product application and the panel may include different skin material grades, yield strengths, and other properties in a single panel. Therefore, we desire to be limited only by the scope of the following claims and equivalents thereof.

We claim:

1. A method of forming a panel for an overhead door, comprising:

juxtaposing a first edge of a first rail skin to a first edge of a front skin;

forming a joint between the first rail skin and the front skin;

juxtaposing a first edge of a second rail skin to a second edge of the front skin;

forming a joint between the second rail skin and the front skin;

roll forming a first rail from the first rail skin; and roll forming a second rail from the second rail skin, wherein the forming a joint between the first rail skin and the front skin step further comprises forming the joint so that the front skin and the first rail skin are coplanar in an area away from the joint and prior to roll forming the first rail in the first rail skin.

2. The method of claim 1 wherein a thickness of the front skin is different from a thickness of at least one of the first and second rail skins.

3. The method of claim 2, wherein the front skin thickness is less than the skin thickness of both the first and second rail skins.

4. The method of claim 1, wherein the front skin first edge and the first rail skin first edge are joined by a first lock seam.

5. The method of claim 4, wherein joining the edges of the front skin and first rail skin further comprises:

bending the first edge of the first rail skin to form a return leg and a fold therein;

bending the first edge of the front skin to form a return leg and a fold therein; and interlocking the first edges of the first rail skin and front skin to form the first lock seam.

6. The method of claim 1, wherein the front skin second edge and the second rail skin first edge are joined by a second lock seam.

7. The method of claim 6, wherein joining the edges of the front skin and second rail skin further comprises:

bending the first edge of the second rail skin to form a return leg and a fold therein;

bending the second edge of the front skin to form a return leg and a fold therein; and interlocking the first edge of the second rail skin and the second edge of the front skin to form the second lock seam.

8. The method of claim 1, wherein the forming the joint so that the front skin and the first rail skin are coplanar step further comprises:

forming a jog adjacent an edge of one of the first rail skin or front skin.

9. The method of claim 1, wherein the forming a joint between the second rail skin and the front skin step further comprises:

forming the joint so that the front skin and the second rail skin are coplanar in an area away from the joint and prior to roll forming the second rail in the second rail skin.

10. The method of claim 9, wherein the forming the joint so that the front skin and the second rail skin are coplanar step further comprises:

forming a jog adjacent an edge of one of the second rail skin or front skin.

11. The method of claim 1, wherein the roll forming of the first and second rails step further comprises:

roll forming a first bend at an intersection between a front face of the panel and the first rail; and roll forming a second bend at an intersection between the front face of the panel and the second rail.

12. The method of claim 11, wherein the first rail skin is joined to the front skin at a first joint and the second rail skin is joined to the front skin at a second joint, the first and second joints being positioned outboard of the first and second bends, respectively, and being spaced from the front face of the panel.

13. The method of claim 11, wherein the first rail skin is joined to the front skin at a first joint and the second rail skin is joined to the front skin at a second joint, the first and second joints being positioned inboard of the first and second bends, respectively, and on the front face of the panel.

14. The method of claim 1, wherein the roll forming of the first rail occurs after the joining of the first rail skin to the front skin and the roll forming of the second rail occurs after the joining of the second rail skin to the front skin.

15. The method of claim 1, wherein the front skin, first rail skin, and second rail skin are each separate sheets of material.

16. The method of claim 1, further comprising:

roll forming the first rail skin from more than one ply of material.

17. The method of claim 1, further comprising:

roll forming the second rail skin from more than one ply of material.

* * * * *